United States Patent [19]

Smith

[11] 4,236,287

[45] Dec. 2, 1980

[54] METHOD OF MAKING A RUGGEDIZED HIGH CURRENT DENSITY CATHODE

[75] Inventor: Bernard Smith, Neptune, N.J.

[73] Assignee: The United States of America as represented by the Secretary of the Army, Washington, D.C.

[21] Appl. No.: 51,934

[22] Filed: Jun. 25, 1979

[51] Int. Cl.[3] ..... H01J 9/12

[52] U.S. Cl. ..... 29/25.18; 29/25.17

[58] Field of Search ..... 29/25.17, 25.18

[56] References Cited

U.S. PATENT DOCUMENTS

| | | | |
|---|---|---|---|
| 2,945,150 | 7/1960 | DeSantis et al. | 313/346 R |
| 3,076,916 | 2/1963 | Koppius | 313/346 R |
| 3,118,080 | 1/1964 | Koppius | 427/77 X |
| 3,303,559 | 2/1967 | Holtzclaw | 428/567 X |
| 3,525,135 | 8/1970 | Bondley | 29/25.17 |
| 3,971,110 | 7/1976 | Thomas et al. | 427/77 X |

*Primary Examiner*—Richard B. Lazarus

*Attorney, Agent, or Firm*—Nathan Edelberg; Jeremiah G. Murray; Roy E. Gordon

[57] ABSTRACT

A high current density cathode capable of operating at current densities of $2A/cm^2$ to $30A/cm^2$ in the temperature range of 900 degrees C. to 1125 degrees C. is prepared by machining a porous high purity tungsten pellet containing copper in its pores and also containing about 0.6 to 2 weight percent of an activator to the desired cathode shape without reducing the pores of the emitter pellet. The pellet is then fired at 1800 degrees C. in a non-oxidizing atmosphere to remove the copper filler material. The pellet is then impregnated with $Ba_5Sr(WO_6)2$ at a temperature of 1900 degrees C. in a dry inert gas atmosphere and the impregnated emitter then fired in dry hydrogen atmosphere at about 1840 degrees C. for about 2.5 to 5 minutes.

9 Claims, No Drawings

METHOD OF MAKING A RUGGEDIZED HIGH CURRENT DENSITY CATHODE

The invention described herein may be manufactured, used and licensed by or for the Government for governmental purposes without the payment to me of any royalty thereon.

This invention relates in general to a method of making a cathode, and in particular to a method of making a high current density cathode capable of operating at current densities of 2 Amperes/cm$^2$ to 30 Amperes/cm$^2$ in the temperature range of 900 degrees C. to 1125 degrees C.

BACKGROUND OF THE INVENTION

A difficulty encountered in the development of microwave or millimeter wave tubes has been the unavailability of a viable ruggedized high current density cathode capable of operating at current densities of 2A/cm$^2$ to 30A/cm$^2$ in the temperature range of 900 degrees C. to 1125 degrees C.

Heretofore, tungstate cathodes made by high compaction pressing have been used to meet high current density requirements. The difficulty with such cathodes has been their inability to be made in any geometry capable of operating at 2A/cm$^2$ to 30A/cm$^2$ in the temperature range of 900 degrees C. to 1125 degrees C. Moreover, the fabrication of the cathode is costly; the shape in which it can be mae is limited; the cathode is subject to degradation; and its emitter life is too short. Then too, cathodes fabricated by high compaction pressing require special handling.

SUMMARY OF THE INVENTION

The general object of this invention is to provide a method of making a high current density cathode that will be suitable for use in microwave or millimeter wave tubes. A further object of the invention is to provide such a method wherein the cathode will be capable of delivering high continuous emission densities at relatively low operating temperatures. A more particular object of the invention is to provide such a method wherein the cathode will be capable of operating at current densities of 2A/cm$^2$ to 30A/cm$^2$ in the temperature range of 900 degrees C. to 1125 degrees C. Further objects of the invention are to provide such a method that will be economic, not limited as to the shape of the cathode, provide a cathode that is not subject to degradation, and provide a cathode with a long emitter life.

The foregoing objects have now been attained by making the tungstate cathodes by impregnation. More particularly, the cathode is prepared by machining a porous high purity tungsten pellet containing copper in its pores and also containing about 0.6 to 2 weight percent of an activator to the desired cathode shape without reducing the pores of the emitter pellet. The pellet is then fired at 1800 degrees C. in a non-oxidizing atmosphere to remove the copper filler material. The pellet is then impregnated with $Ba_5Sr(WO_6)_2$ at a temperature of 1900 degrees C. in a dry inert gas atmosphere and the impregnated emitter then fired in a dry hydrogen atmosphere at about 1840 degrees C. for about 2.5 to 5 minutes. The $Ba_5Sr(WO_6)_2$ impregnant can be made by mixing stoichiometric amounts of barium carbonate, strontium carbonate, and tungsten trioxide according to the equation $5BaCO_3+SrCO_3+2WO_3 \rightarrow Ba_5Sr(WO_6)_2+6CO_2$. The mixture is ball milled overnight and then fired in an air oven at 1475 degrees C. for 2 hours.

DESCRIPTION OF THE PREFERRED EMBODIMENT

A commercially available porous high purity tungsten pellet including copper in its pores and 0.6 percent by weight to 2 percent by weight of hafnium as an activator is used. The pellet is machined to the desired shape without closing or reducing the pores of the emitter pellet. After machining, the tungsten is fired at 1800 degrees C. in vacuum or an inert gas atmosphere or dry hydrogen to remove this copper filler material. After firing, the cathode is impregnated with $Ba_5Sr(WO_6)_2$ at a temperature of 1900 degrees C. in a dry inert gas atmosphere. After firing in an inert atmosphere to impregnate the cathode, the emitter is fired in a dry hydrogen atmosphere to a temperature of 1840 degrees C. for 2.5 to 5 minutes. Upon completion of this firing, the emitter is ready for incorporating into a tube.

In the above described method, in lieu of the copper filler, one might use a plastic filler. In lieu of the tungsten pellet, one might use a tungsten iridium pellet, a tungsten-rhenium pellet or a tungsten osmium pellet. In lieu of hafnium as the activator, one might use zirconium or small quantities of titanium or carbon. Moreover, the final hydrogen firing step may be eliminated. In the preparation of the $Ba_5Sr(WO_6)_2$ impregnant, the impregnation temperature of the pellet can be reduced by including 5 to 10 percent by weight of either aluminum oxide, calcium oxide or zirconium oxide.

The cathode prepared by the method of the invention costs less than tungstate cathodes prepared by the pressing method. It is further characterized by increased life and emission, removal of geometrical restriction, is more rugged, and capable of operating in vacuums of as low as $10^{-5}$ torr to $10^{-6}$ torr.

I wish it to be understood that I do not desire to be limited to the exact details as described for obvious modifications will occur to a person skilled in the art.

What is claimed is:

1. Method of making a high current density cathode capable of operating at current densities of 2A/cm$^2$ to 30A/cm$^2$ in the temperature range of 900 degrees C. to 1125 degrees C., said method including the steps of A. machining a porous high purity pellet containing copper in its pores and also containing about 0.6 to 2 weight percent of an activator to the desired cathode shape without reducing the pores of the emitter pellet, wherein said pellet is selected from the group consisting of a tungsten pellet, a tungsten iridium pellet, a tungsten rhenium pellet and a tungsten osmium pellet, and wherein the activator is selected from the group consisting of hafnium and zirconium, B. firing the pellet at 1800 degrees C. in a non-oxidizing atmosphere selected from the group consisting of an inert gas and dry hydrogen to remove the copper filler material, C. impregnating the pellet with $Ba_5Sr(WO_6)_2$ at about 1900 degrees C. in a dry inert gas atmosphere, wherein said $Ba_5Sr(WO_6)_2$ impregnant is made by mixing stoichiometric amounts of barium carbonate, strontium carbonate, and tungsten trioxide according to the equation $5BaCO_3+SrCO_3+2WO_3 \rightarrow Ba_5Sr(WO_6)_2+6CO_2$, ball milling the mixture overnight, and then firing in an air oven at 1475 degrees C. for 2 hours, and D. firing the impregnated emitter in a dry hydrogen atmosphere at about 1840 degrees C. for about 2.5 to 5 minutes.

2. Method according to claim 1 wherein the pellet is a tungsten pellet.

3. Method according to claim 1 wherein the pellet is a tungsten rhenium pellet.

4. Method according to claim 1 wherein the pellet is a tungsten iridium pellet.

5. Method according to claim 1 wherein the pellet is a tungsten osmium pellet.

6. Method according to claim 1 wherein the activator is hafnium.

7. Method according to claim 1 wherein the activator is zirconium.

8. Method according to claim 1 wherein the nonoxidizing atmosphere is an inert gas.

9. Method according to claim 1 wherein the nonoxidizing atmosphere is dry hydrogen.

* * * * *